US007696963B2

(12) United States Patent
Choi et al.

(10) Patent No.: US 7,696,963 B2
(45) Date of Patent: Apr. 13, 2010

(54) BUFFER CIRCUIT AND ORGANIC LIGHT EMITTING DISPLAY WITH DATA INTEGRATED CIRCUIT USING THE SAME

(75) Inventors: Sang-Moo Choi, Suwon (KR); Oh-Kyong Kwon, Seoul (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 1147 days.

(21) Appl. No.: 11/312,476

(22) Filed: Dec. 21, 2005

(65) Prior Publication Data

US 2006/0139258 A1 Jun. 29, 2006

(30) Foreign Application Priority Data

Dec. 24, 2004 (KR) ..... 10-2004-0112515

(51) Int. Cl.
*G09G 3/32* (2006.01)

(52) U.S. Cl. ..... 345/82; 345/76; 345/80; 345/83; 345/98; 345/100

(58) Field of Classification Search ..... 345/55, 345/76, 77, 80, 82, 83, 84, 87, 90, 98, 100, 345/204, 211, 212, 213, 214; 326/62, 80, 326/82, 83, 86

See application file for complete search history.

(56) References Cited

U.S. PATENT DOCUMENTS 6,498,596 B1 12/2002 Nakamura et al.
6,870,493 B2 3/2005 Yang
7,068,076 B2 * 6/2006 Azami ..... 326/83
7,307,455 B2 * 12/2007 Choi et al. ..... 326/82

(Continued)

FOREIGN PATENT DOCUMENTS

JP 08-160387 6/1996

(Continued)

OTHER PUBLICATIONS

Office Action from the Chinese SIPO issued in Applicant's corresponding Chinese Patent Application No. 200510137397.X dated Feb. 15, 2008.

(Continued)

*Primary Examiner*—My-Chau T Tran
(74) *Attorney, Agent, or Firm*—Robert E. Bushnell, Esq.

(57) ABSTRACT

In an organic light emitting display with a data integrated circuit using the same, a buffer circuit comprises: a first capacitor receiving gradation voltage through a first terminal; a first inverter having an input terminal connected to a second terminal of the first capacitor; a second capacitor having a first terminal connected to an output terminal of the first inverter; a second inverter having an input terminal connected to a second terminal of the second capacitor; a third capacitor having a first terminal connected to an output terminal of the second inverter; and a first transistor connected to a second terminal of the third capacitor and controlling current flowing from a first power source to a data line so as to supply the gradation voltage to the data line in correspondence to the voltage supplied by the third capacitor. With this configuration, the gradation voltage is supplied regardless of the threshold voltages of the transistors.

15 Claims, 8 Drawing Sheets

U.S. PATENT DOCUMENTS

| | | | | |
|---|---|---|---|---|
| 7,355,581 | B2 * | 4/2008 | Kim | 345/98 |
| 7,436,385 | B2 * | 10/2008 | Kim et al. | 345/98 |
| 2003/0034806 | A1 * | 2/2003 | Azami | 327/94 |
| 2004/0164886 | A1 | 8/2004 | Hsueh | |
| 2005/0001799 | A1 * | 1/2005 | Kim | 345/87 |
| 2005/0007325 | A1 * | 1/2005 | Kim et al. | 345/87 |
| 2005/0017769 | A1 | 1/2005 | Nakashima | |

FOREIGN PATENT DOCUMENTS

| | | |
|---|---|---|
| JP | 2000-305535 | 11/2000 |
| JP | 2001-125545 | 5/2001 |
| JP | 2004-4241 | 1/2004 |
| JP | 2005-137846 | 6/2005 |
| JP | 2005-333635 | 12/2005 |

OTHER PUBLICATIONS

Office Action from Japanese Patent Office issued in Applicant's corresponding Japanese Patent Application No. 2005-299406 dated Apr. 7, 2009 with Request for Entry of the Accompanying Office Action.

* cited by examiner

BUFFER CIRCUIT AND ORGANIC LIGHT EMITTING DISPLAY WITH DATA INTEGRATED CIRCUIT USING THE SAME

CLAIM OF PRIORITY

This application makes reference to, incorporates the same herein, and claims all benefits accruing under 35 U.S.C. §119 from an application for BUFFER CIRCUIT AND ORGANIC LIGHT EMITTING DISPLAY WITH DATA INTEGRATED CIRCUIT USING THE SAME earlier filed in the Korean Intellectual Property Office on the 24 of Dec. 2004 and there duly assigned Serial No. 2004-112515.

BACKGROUND OF THE INVENTION

1. Technical Field

The present invention relates to a buffer circuit and an organic light emitting display with a data integrated circuit using the same and, more particularly, to a buffer circuit and an organic light emitting display with a data integrated circuit using the same, in which a threshold voltage is compensated to supply a correct output voltage.

2. Related Art

Recently, various flat panel displays have been developed, and they substitute for cathode ray tube (CRT) displays because the CRT displays are relatively heavy and bulky. The flat panel display includes a liquid crystal display (LCD), a field emission display (FED), a plasma display panel (PDP), an organic light emitting display (OLED), etc.

Among the flat panel displays, the organic light emitting display can emit light for itself by electron-hole recombination. Such an organic light emitting display has advantages in that response time is relatively fast and power consumption is relatively low. Generally, the organic light emitting display employs a transistor provided in each pixel for supplying current corresponding to a data signal to an organic light emitting diode, thereby allowing the organic light emitting diode to emit light.

The organic light emitting display generates a data signal based on external data, and supplies the data signal to the pixel through a data line, thereby displaying an image having desired brightness. At least one data integrated circuit is employed for converting the external data into the data signal.

The data integrated circuit transforms the external data into a voltage corresponding to gradation, and supplies the voltage as the data signal to the data line via a buffer circuit. Furthermore, in each pixel, current is applied to the organic light emitting diode in correspondence to the voltage of the data signal supplied through the data line, thereby displaying a predetermined image.

In the data integrated circuit, the buffer circuit should ideally transmit the data signal to the data line without a voltage drop. However, the buffer circuit cannot actually transmit the data signal to the data line with a voltage drop as much as the threshold voltage of the transistor because it comprises the plurality of transistors, so that the pixels cannot display an image having the desired brightness.

SUMMARY OF THE INVENTION

Accordingly, it is an aspect of the present invention to provide a buffer circuit and an organic light emitting display with a data integrated circuit using the same, in which a threshold voltage is compensated to supply a correct output voltage.

The foregoing and/or other aspects of the present invention are achieved by providing a buffer circuit comprising: a first capacitor receiving gradation voltage through a first terminal; a first inverter having an input terminal connected to a second terminal of the first capacitor; a second capacitor having a first terminal connected to an output terminal of the first inverter; a second inverter having an input terminal connected to a second terminal of the second capacitor; a third capacitor having a first terminal connected to an output terminal of the second inverter; and a first transistor connected to a second terminal of the third capacitor and controlling current flowing from a first power source to a data line so as to supply the gradation voltage to the data line in correspondence to the voltage supplied from the third capacitor.

Another aspect of the present invention is achieved by providing a data integrated circuit comprising: a shift register part; a latch part for storing data corresponding to signals supplied in sequence from the shift register part; a D/A converter for generating a gradation voltage corresponding to a gradation level of the data; and a plurality of buffers for supplying the gradation voltage to a data line. Each buffer comprises: a first capacitor receiving an external gradation voltage through a first terminal; a first inverter having an input terminal connected to a second terminal of the first capacitor; a second capacitor having a first terminal connected to an output terminal of the first inverter; a second inverter having an input terminal connected to a second terminal of the second capacitor; a third capacitor having a first terminal connected to an output terminal of the second inverter; and a first transistor connected to a second terminal of the third capacitor and controlling current flowing from a first power source to a data line so as to supply the gradation voltage to the data line in correspondence to the voltage supplied from the third capacitor.

Still another aspect of the present invention is achieved by providing an organic light emitting display comprising: a plurality of scan lines and data lines; a scan driver supplying a scan signal to the scan line; and a data driver comprising a plurality of buffers connected to the respective data lines and supplying a data signal to the data line. Each buffer comprises: a first capacitor receiving external gradation voltage through a first terminal; a first inverter having an input terminal connected to a second terminal of the first capacitor; a second capacitor having a first terminal connected to an output terminal of the first inverter; a second inverter having an input terminal connected to a second terminal of the second capacitor; a third capacitor having a first terminal connected to an output terminal of the second inverter; and a first transistor connected to a second terminal of the third capacitor and controlling current flowing from a first power source to a data line so as to supply the gradation voltage to the data line in correspondence to the voltage supplied from the third capacitor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, preferable embodiments according to the present invention will be described with reference to the accompanying drawings, wherein the preferred embodiments of the present invention are provided so as to be readily understood by those skilled in the art.

Figure 1:
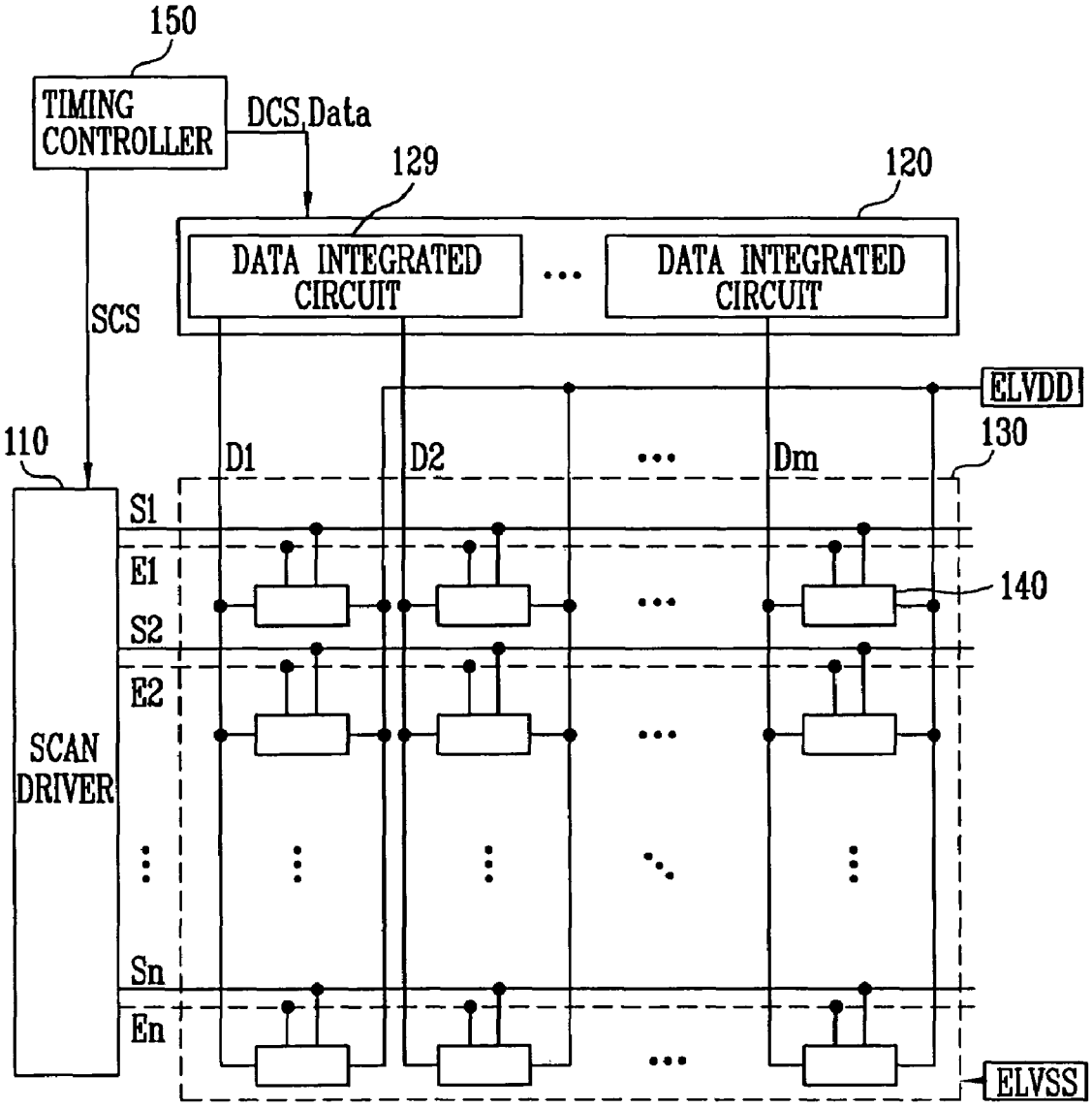
FIG. 1 illustrates an organic light emitting display according to an embodiment of the present invention.

FIG. 1 illustrates an organic light emitting display according to an embodiment of the present invention.

Referring to FIG. 1, an organic light emitting display according to an embodiment of the present invention comprises: a pixel portion 130 including a plurality of pixels 140 formed in a region intersected by a plurality of scan lines S1 thru Sn and a plurality of data lines D1 thru Dm; a scan driver 110 to drive the scan lines S1 thru Sn; a data driver 120 to drive the data lines D1 thru Dm; and a timing controller 150 to control the scan driver 110 and the data driver 120.

The scan driver 110 generates a scan signal in response to a scan control signal SCS supplied by the timing controller 150, and supplies the generated scan signals to the scan lines S1 thru Sn in sequence. Furthermore, the scan driver 110 generates an emission control signal in response to the scan control signal SCS, and supplies the generated emission control signals to emission control lines E1 thru En in sequence.

The data driver 120 generates a data signal in response to a data control signal DCS supplied by the timing controller 150, and supplies the generated data signals to the data lines D1 thru Dm. For this, the data driver 120 comprises at least one data integrated circuit 129. The data integrated circuit 129 converts the external data into the data signal, and supplies it to the data lines D1 thru Dm. Detailed configurations of the data integrated circuit 129 will be described later.

The timing controller 150 generates the data control signal DCS and the scan control signal SCS in response to external synchronization signals. The data control signal DCS generated by the timing controller 150 is supplied to the data driver 120, and the scan control signal SCS is supplied to the scan driver 110. Furthermore, the timing controller 150 rearranges the external data and supplies it to the data driver 120.

The pixel portion 130 receives first power ELVDD and second power ELVSS from an external source. The first power ELVDD and the second power ELVSS supplied to the pixel portion 130 are transmitted to each pixel 140. Then, the pixels 140 receiving the first power ELVDD and the second power ELVSS display an image corresponding to the data signal transmitted by the data integrated circuit 129.

Figure 2:
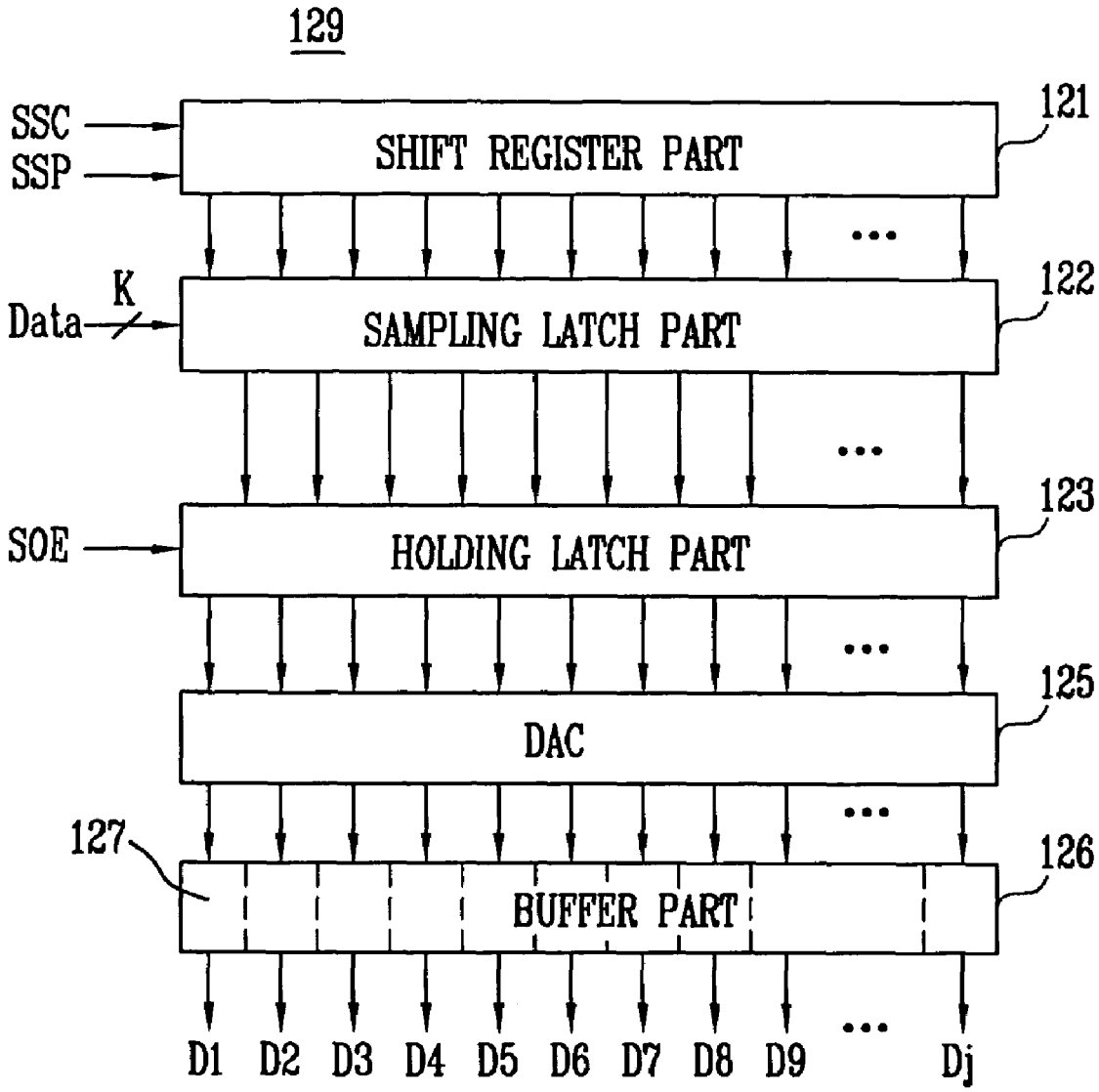
FIG. 2 is a block diagram of a first embodiment of the data integrated circuit of FIG. 1.

FIG. 2 is a block diagram of a first embodiment of the data integrated circuit of FIG. 1. In this case, the data integrated circuit 129 comprises j channels to which j data lines are connected, where j is a natural number.

Referring to FIG. 2, the data integrated circuit 129 according to the first embodiment comprises: a shift register part 121 to generate sampling signals in sequence; a sampling latch part 122 to store the data Data in sequence in response to the sampling signals; a holding latch circuit 123 to temporarily store the data Data of the sampling latch part 122, and to transmit the stored data Data to a digital/analog converter (hereinafter, referred to as "DAC") 125; the DAC 125 to generate gradation voltage corresponding to gradation of the data Data; and a buffer part 126 to supply the gradation voltage to the data lines D.

The shift register part 121 receives a source shift clock SSC and a source start pulse SSP from the timing controller 150. The shift register part 121 receiving the source shift clock SSC and the source start pulse SSP shifts the source start pulse SSP per period of the source shift clock SSC, thereby generating j sampling signals in sequence. For this, the shift register part 121 comprises j shift registers.

The sampling latch part 122 sequentially stores the data Data in response to the sampling signals supplied in sequence by the shift register part 121. In this respect, the sampling latch part 122 comprises j sampling latches to store j data Data. Furthermore, each size of the sampling latches corresponds to bits of the data Data. For example, in a case of k bits data Data, each sampling latch has a size corresponding to k bits.

The holding latch circuit 123 receives and stores the data Data from the sampling latch part 122 when it receives a source output enable signal SOE from the timing controller 150. Furthermore, the holding latch circuit 123 supplies the data Data stored therein to the DAC 125 when it receives the source output enable signal SOE from the timing controller 150. For this, the holding latch circuit 123 comprises the same number of holding latches as the j sampling latches provided in the sampling latch part 122. Furthermore, each size of the holding latches is provided to store the same number of bits as k bits to be stored in the sampling latches of the sampling latch part 122.

The DAC 125 generates the gradation voltage corresponding to the bits (i.e., gradation level) of the data Data, and supplies the gradation voltage to the buffer part 126.

The buffer part 126 transmits the data signals from the DAC 125 to j data lines D1 thru Dj. For this, the buffer part 126 comprises j buffers 127. Each of buffers 127 receives the data signal and transmits it to the data lines D1 thru Dj. In this respect, the buffer 127 transmits the data signal to the data lines D1 thru Dj without a voltage drop due to the threshold voltage of a transistor provided therein.

Figure 3:
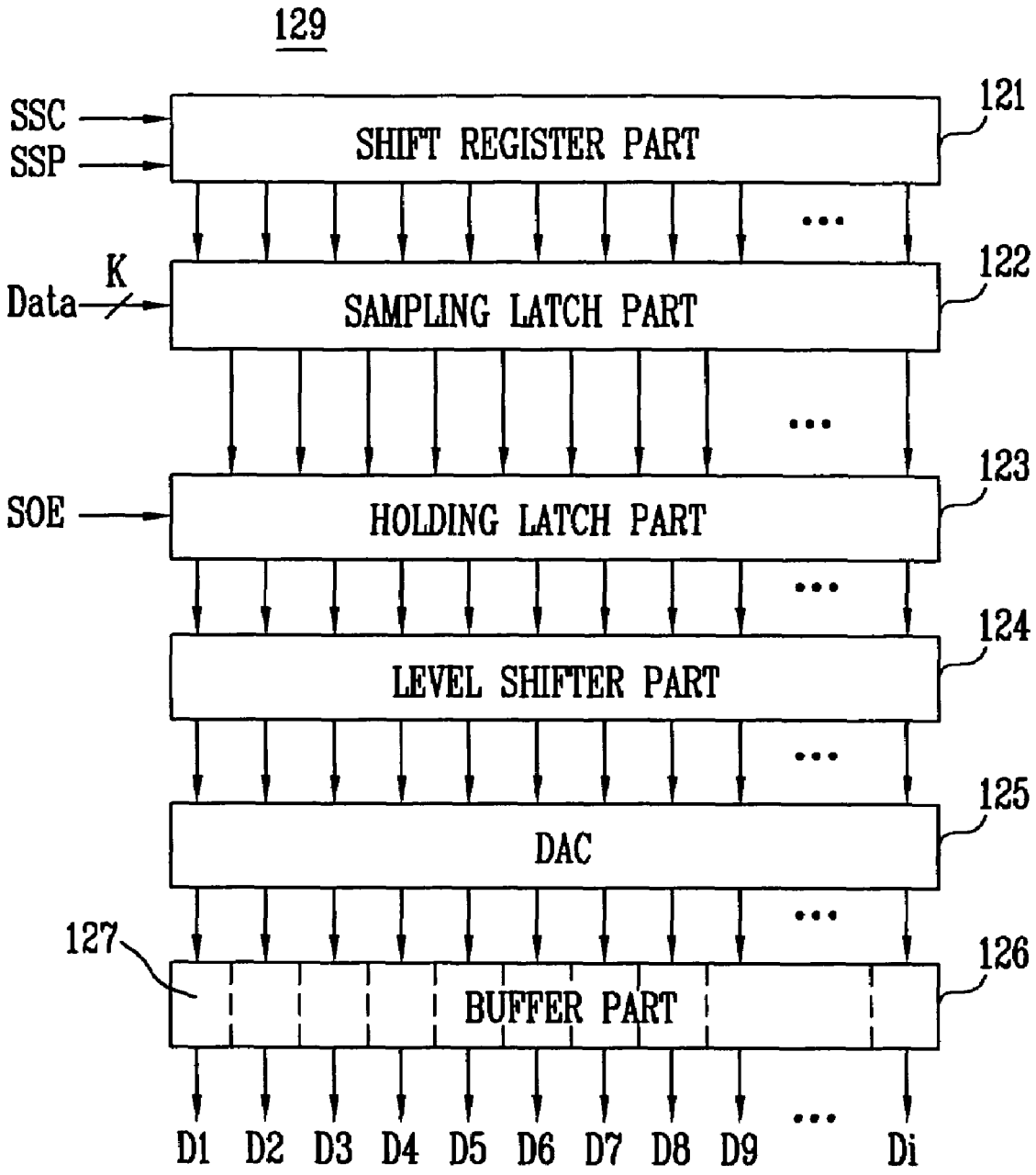
FIG. 3 is a block diagram of a second embodiment of the integrated circuit of FIG. 1.

Meanwhile, according to an embodiment of the present invention, a level shifter part 124 may be additionally provided between the holding latch part 123 and the DAC 125 as shown in FIG. 3, which is a block diagram of a second embodiment of the integrated circuit of FIG. 1. The level shifter part 124 increases the voltage level of the data Data supplied by the holding latch part 123, and then supplies it to the DAC 125. If the data Data having a high voltage level is directly supplied from an external system to the data integrated circuit 129, circuit elements are needed according to the high voltage level, and thus production cost increases. Therefore, the data integrated circuit 129 according to an embodiment of the present invention preferably receives the data Data having a low voltage level from the external system, and increases the voltage of the data Data using the level shifter part 124.

Figure 4:
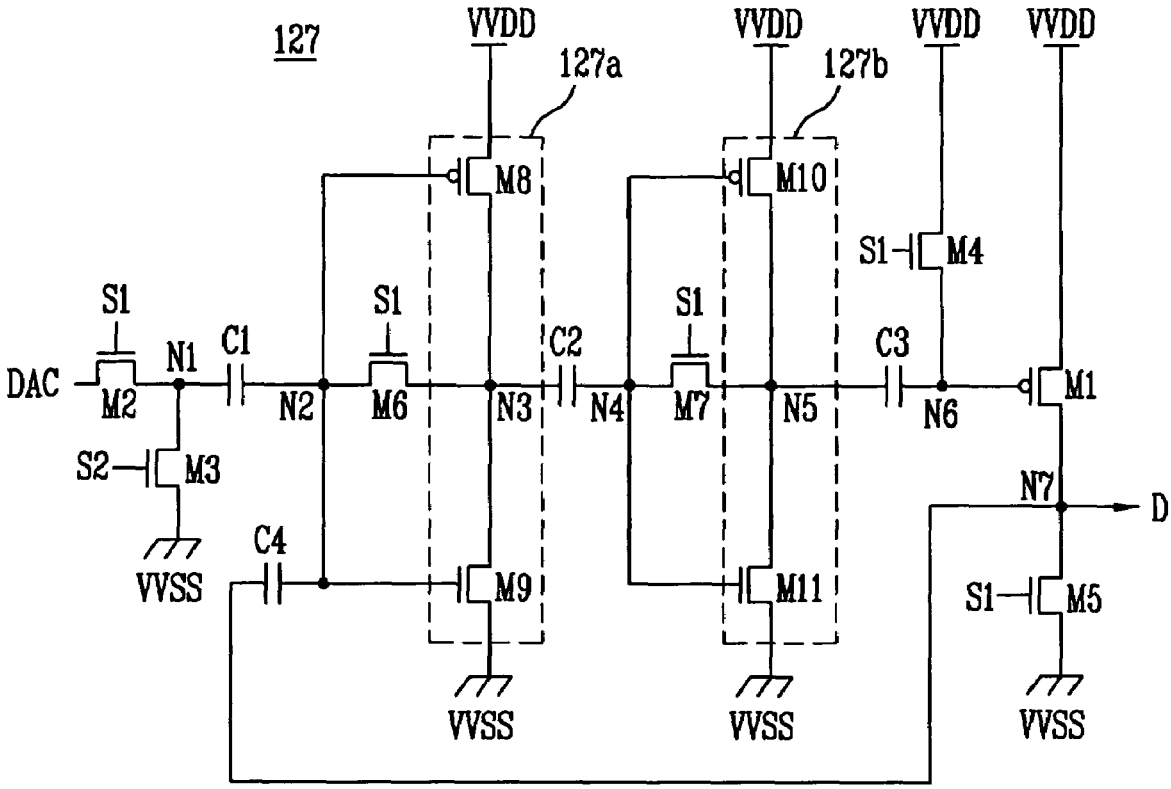
FIG. 4 is a circuit diagram of a first embodiment of the buffer circuit of FIGS. 2 and 3.
Figure 5:
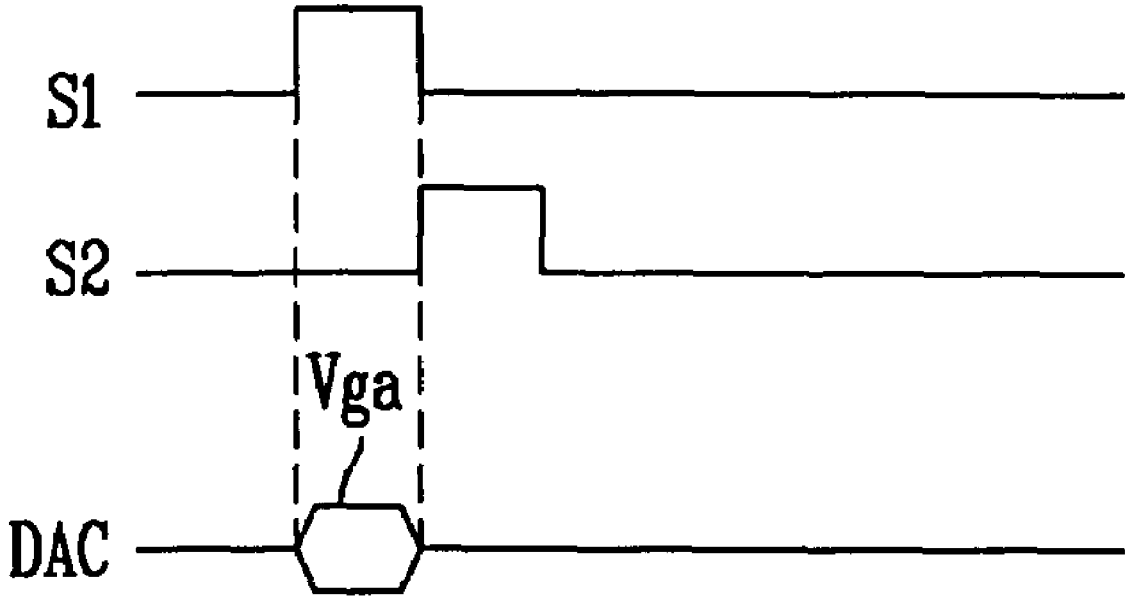
FIG. 5 shows waveforms of signals supplied to the buffer circuit of FIG. 4.

FIG. 4 is a circuit diagram of a first embodiment of the buffer circuit of FIGS. 2 and 3, and FIG. 5 shows waveforms of signals supplied to the buffer circuit of FIG. 4.

Referring to FIGS. 4 and 5, the buffer 127 according to the first embodiment comprises: a first inverter 127*a*; a second inverter 127*b*; a first transistor M1 connected between the data line D and a third power source line for third power VVDD; a second transistor M2 and a first capacitor C1 connected between the DAC 125 and the first inverter 127*a*; a second capacitor C2 connected between the first inverter 127*a* and the second inverter 127*b*; and a third capacitor C3 connected between the second inverter 127*b* and the first transistor M1.

Furthermore, the buffer 127 according to the first embodiment comprises: a third transistor M3 connected between a fourth power source line for fourth power VVSS and a first node N1 used as a common terminal of both the second transistor M2 and the first capacitor C1; a fourth transistor M4 connected between the third power source line and a sixth node N6 used as a common terminal of both the third capacitor C3 and the first transistor M1; a fifth transistor M5 connected between the fourth power source line and a seventh node N7 used as a common terminal of both the first transistor M1 and the data line D; a sixth transistor M6 connected between an input terminal (i.e., second node N2) and an output terminal (i.e., third node N3) of the first inverter 127*a*; a seventh transistor M7 connected between an input terminal (i.e., fourth node N4) and an output terminal (i.e., fifth node N5) of the second inverter 127*b*; and a fourth capacitor C4 connected between the second node N2 and the seventh node N7.

The first transistor M1 controls current flowing from the third power source line to the seventh node N7 in correspondence to voltage applied to the sixth node N6. At this point, the first transistor M1 supplies the current until a gradation voltage Vga is applied to the seventh node N7. In this respect, the gradation voltage Vga applied to the seventh node N7 is supplied as the data signal to the pixel 140.

The second transistor M2 supplies the gradation voltage Vga from the DAC 125 to the first node N1 in response to a first control signal S1.

The third transistor M3 electrically connects the fourth power source line VVSS with the first node N1 in response to a second control signal S2. In this respect, the fourth power VVSS has a lower voltage level than the third power VVDD, for example, it may have a ground voltage level GND. Hereinafter, presume that the fourth power VVSS have the ground voltage level GND. The first and second control signals S1 and S2 are supplied in sequence as shown in FIG. 5. Furthermore, the DAC 125 supplies the gradation voltage Vga in response to the first control signal S1.

The fourth transistor M4 supplies the third power VVDD to the sixth node N6 in response to the first control signal S1. When the voltage of the third power VVDD is applied to the sixth node N6, the voltages applied to a gate terminal and a source terminal of the first transistor M1 are equalized, thereby turning off the first transistor M1.

The fifth transistor M5 applies the voltage of the fourth power VVSS to the seventh node N7 (i.e., data line D) in response to the first control signal S1. Then, the voltage of the seventh node N7 is initialized by the voltage of the fourth power VVSS.

The first inverter 127*a* comprises an eighth transistor M8 and a ninth transistor M9, which are different in impurity type, and which are connected between the third power VVDD and the fourth power VVSS. For example, the eighth transistor M8 is of a p-type, and the ninth transistor M9 is of an n-type. In this respect, each gate terminal of the eighth transistor M8 and the ninth transistor M9 is connected to the first capacitor C1 (i.e., second node N2), and is thus operated by the voltage supplied by the first capacitor C1.

The sixth transistor M6 is connected between the input terminal N2 and the output terminal N3 of the first inverter 127*a*, and is turned on in response to the first control signal S1. When the sixth transistor M6 is turned on, the voltages at the input terminal N2 and the output terminal N3 are equalized.

The second inverter 127*b* comprises a tenth transistor M10 and an eleventh transistor M11, which are different in impurity type, and which are connected between the third power VVDD and the fourth power VVSS. For example, the tenth transistor M10 is of a p-type, and the eleventh transistor M11 is of an n-type. In this respect, each gate terminal of the tenth transistor M10 and the eleventh transistor M11 is connected to the second capacitor C2 (i.e., fourth node N4), and is thus operated by the voltage supplied by the second capacitor C2.

The seventh transistor M7 is connected between the input terminal N4 and the output terminal N5 of the second inverter 127*b*, and is turned on in response to the first control signal S1. When the seventh transistor M7 is turned on, the voltages at the input terminal N4 and the output terminal N5 of the second inverter 127*b* are equalized.

The fourth capacitor C4 is connected between the seventh node N7 and the second node N2. In this regard, the fourth capacitor C4 feeds the output voltage of the buffer 127, i.e., the voltage applied to the seventh node N7, back to the second node N2. That is, the voltage applied to the second node N2 is changed by the voltage applied to the seventh node N7. When the voltage applied to the seventh node N7 is equal to the gradation voltage Vga, the first transistor M1 is turned off.

Operations of the buffer according to the first embodiment will be described with reference to FIG. 5. First, the first control signal S1 is supplied from an external source. As the first control signal S1 is supplied, the second transistor M2, the sixth transistor M6, the seventh transistor M7, the fourth transistor m4 and the fifth transistor M5 are turned on.

When the sixth transistor M6 is turned on, the second node N2 and the third node N3 are electrically connected. When the second node N2 and the third node N3 are electrically connected, the voltage of the third power VVDD is applied half to the second node N2 and half to the third node N3, respectively. Likewise, when the seventh transistor M7 is turned on, the voltage of the third power VVDD is applied half to the fourth node N4 and half to the fifth node N5.

When the second transistor M2 is turned on, the gradation voltage Vga is supplied by the DAC 125 to the first node N1. Then, the first capacitor C1 is charged with voltage (about ½ VVDD) corresponding to the difference between the gradation voltage Vga and the voltage applied to the second node N2. In this respect, the voltage applied to the second node N2 is invariable, so that the voltage charged on the first capacitor C1 varies according to the gradation voltage Vga.

When the fourth transistor M4 is turned on, the voltage of the third power VVDD is supplied to the sixth node N6. When the voltage of the third power VVDD is applied to the sixth node N6, the first transistor M1 is turned off. Furthermore, the third capacitor C3 is charged with a voltage corresponding to the difference between the voltages applied to the fifth node N5 and the sixth node N6, respectively. For example, the third capacitor C3 is charged with about one-half of the third power ½ VVDD.

When the fifth transistor M5 is turned on, the fourth power VVSS is supplied to the seventh node N7. As the voltage of the fourth power VVSS is supplied to the seventh node N7, the fourth capacitor C4 is charged with a voltage corresponding to the difference between the voltages applied to the second node N2 and the fourth power VVSS, respectively.

Thereafter, the first control signal S1 is interrupted, and the second control signal S2 is supplied, thereby turning on the third transistor M3. When the third transistor M3 is turned on, the voltage of the fourth power VVSS is applied to the first node N1. Therefore, the voltage applied to the first node N1 drops down from the gradation voltage Vga to the voltage of the fourth voltage VVSS.

Figure 6:
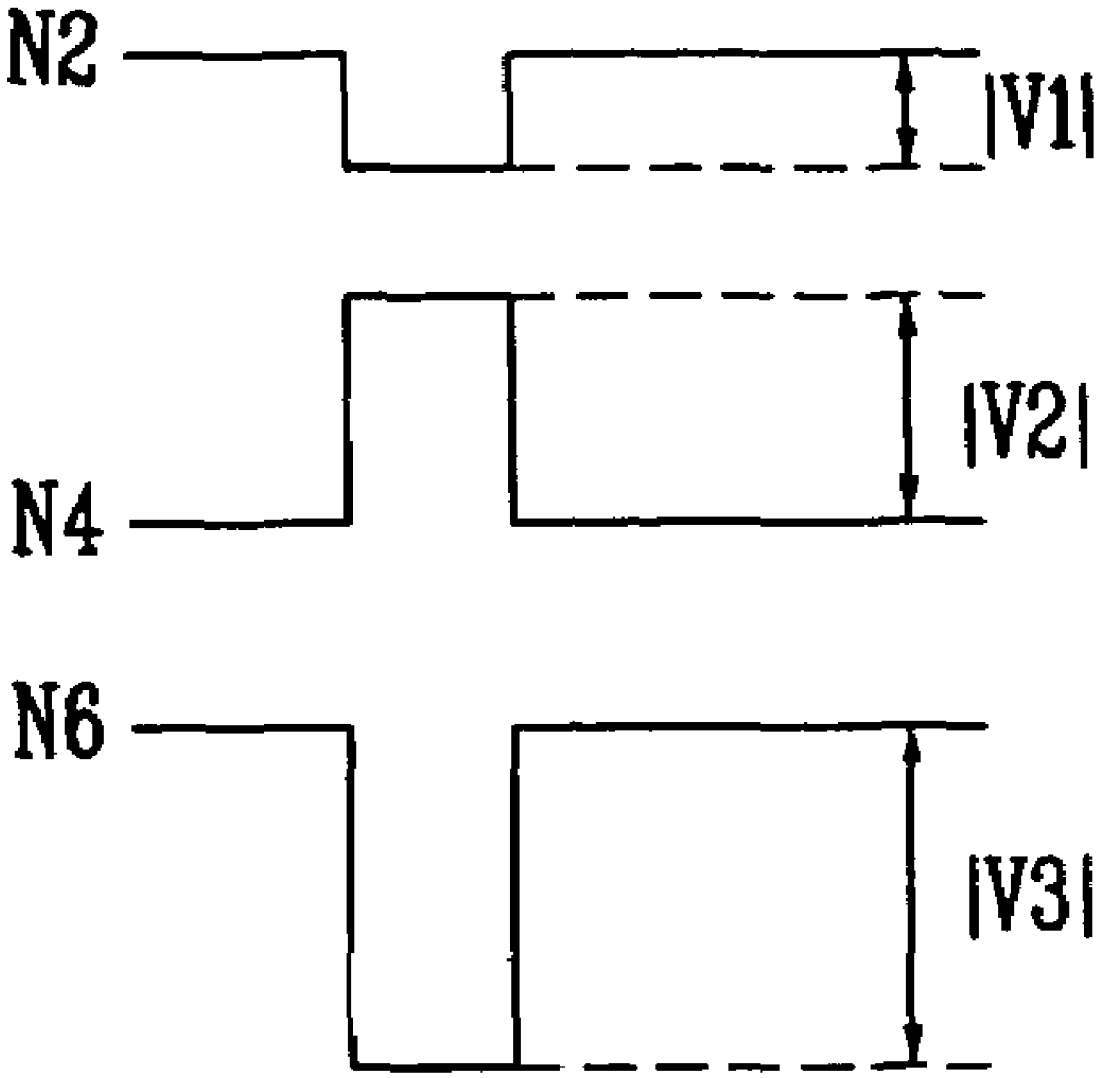
FIG. 6 shows waveforms of signals supplied to a node of FIG. 4.

As the voltage applied to the first node N1 drops down, the voltage applied to the second node N2 connected to the first node N1 via the first capacitor C1 also drops down. For example, the voltage applied to the second node N2 drops down to as little as an absolute first voltage V1 (refer to FIG. 6, which shows waveforms of signals supplied to a node of FIG. 4.

The voltage drop in the second node N2 is determined according to the gradation voltage Vga. In other words, if the gradation voltage Vga is high, the voltage drop in the second node N2 is large also. On the other hand, if the gradation voltage Vga is low, the voltage drop in the second node N2 is small also.

The voltage of the second node N2 is applied to the first inverter 127*a*. At this point, the voltage of the second node N2 drops down, so that the eighth transistor M8 provided in the first inverter 127*a* is turned on. Then, a predetermined voltage is applied to the third node N3, i.e., to the output terminal of the first inverter 127*a*, thereby increasing the voltage of the third node N3. As the voltage applied to the third node N3 increases, the voltage of the fourth node N4 connected to the third node N3 also increases by the second capacitor C2. In this respect, the voltage of the fourth node N4 increases to as much as an absolute second voltage V2 higher than the absolute first voltage V1 (refer to FIG. 6).

The voltage of the fourth node N4 is applied to the second inverter 127*b*. At this point, the voltage of the fourth node N4 increases, so that the eleventh transistor M11 provided in the second inverter 127*b* is turned on. Then, a predetermined voltage is applied to the fifth node N5, i.e., to the output terminal of the second inverter 127*b*, thereby dropping down the voltage of the fifth node N5. As the voltage applied to the fifth node N5 drops down, the voltage of the sixth node N6 connected to the fifth node N6 via the third capacitor C3 also drops down. In this respect, the voltage of the sixth node N6 drops down to as little as an absolute third voltage V3 higher than the absolute second voltage V2 (refer to FIG. 6).

As the voltage of the sixth node N6 drops down, the first transistor M1 is turned on. When the first transistor M1 is turned on, a predetermined current is applied by the third power VVDD to the seventh node N7. In this case, because the absolute third voltage V3 higher than the gradation voltage Vga is applied to the sixth node N6, a relatively large amount of current is applied to the seventh node N7 via the first transistor M1, thereby quickly increasing the voltage of the seventh node N7 to the gradation voltage Vga. When the seventh node N7 has the value of the gradation voltage Vga, the first transistor M1 is turned off.

More specifically, when the gradation voltage Vga is applied to the seventh node N7, the voltage of the second node N2 is also increased by the fourth capacitor C4 in correspondence to the gradation voltage Vga. As the voltage of the second node N2 increases, the voltage applied to the fourth node N4 drops down by the first inverter 127*a*. When the voltage of the fourth node N4 drops down, the voltage of the sixth node N6 is increased by the second inverter 127*b*, thereby turning off the first transistor M1. According to the present invention, when the gradation voltage Vga is applied to the seventh node N7, i.e., to the data line D, the first transistor M1 is turned off. Therefore, the gradation voltage Vga is correctly supplied to the data lined D regardless of the threshold voltages of the transistors.

As described above, the buffer 127 according to the first embodiment supplies the gradation voltage Vga regardless of the threshold voltages of the transistors. That is, the buffer 127 supplies the gradation voltage Vga regardless of the threshold voltages of the transistors, so that it is applicable to drive a wide-screen and high-resolution panel. Furthermore, according to the first embodiment, the absolute voltage higher than the gradation voltage is supplied to the gate terminal of the first transistor M1, thereby enhancing the panel driving speed.

Figure 7:
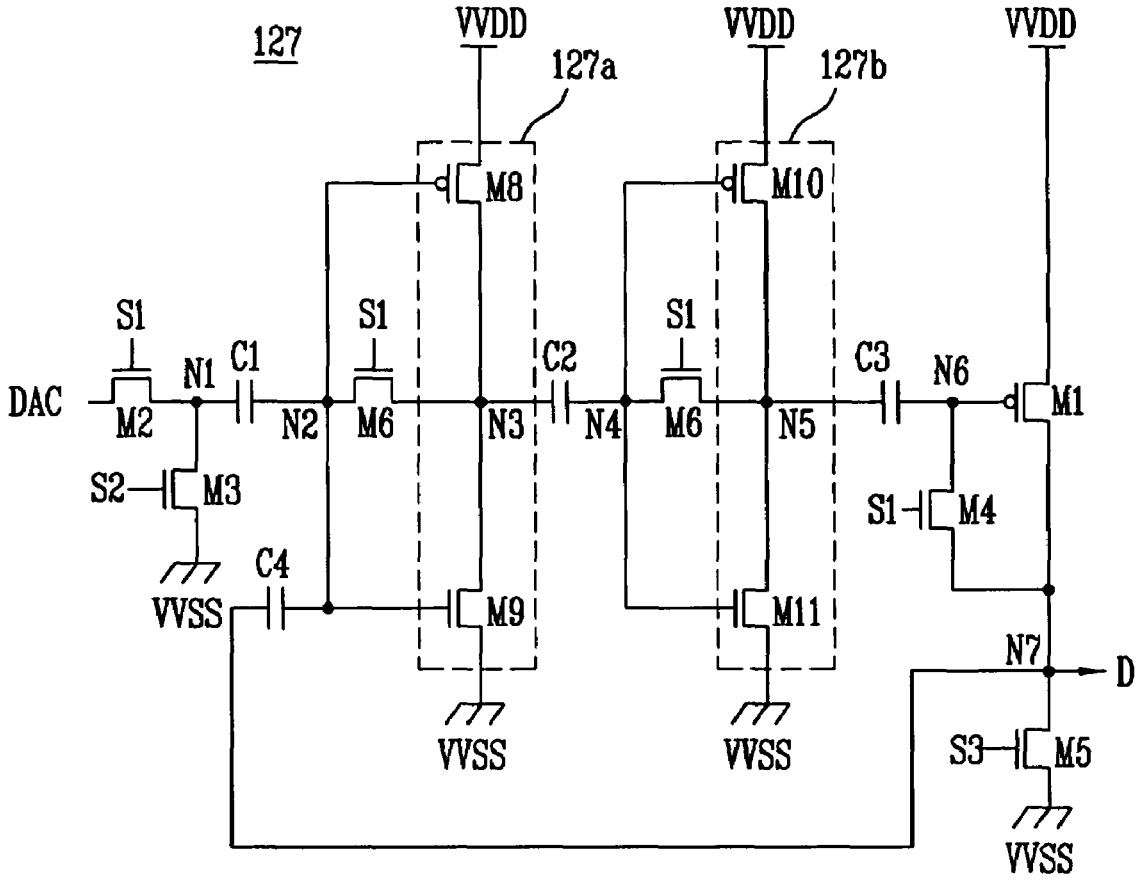
FIG. 7 is a circuit diagram of a second embodiment of the buffer circuit of FIGS. 2 and 3.
Figure 8:
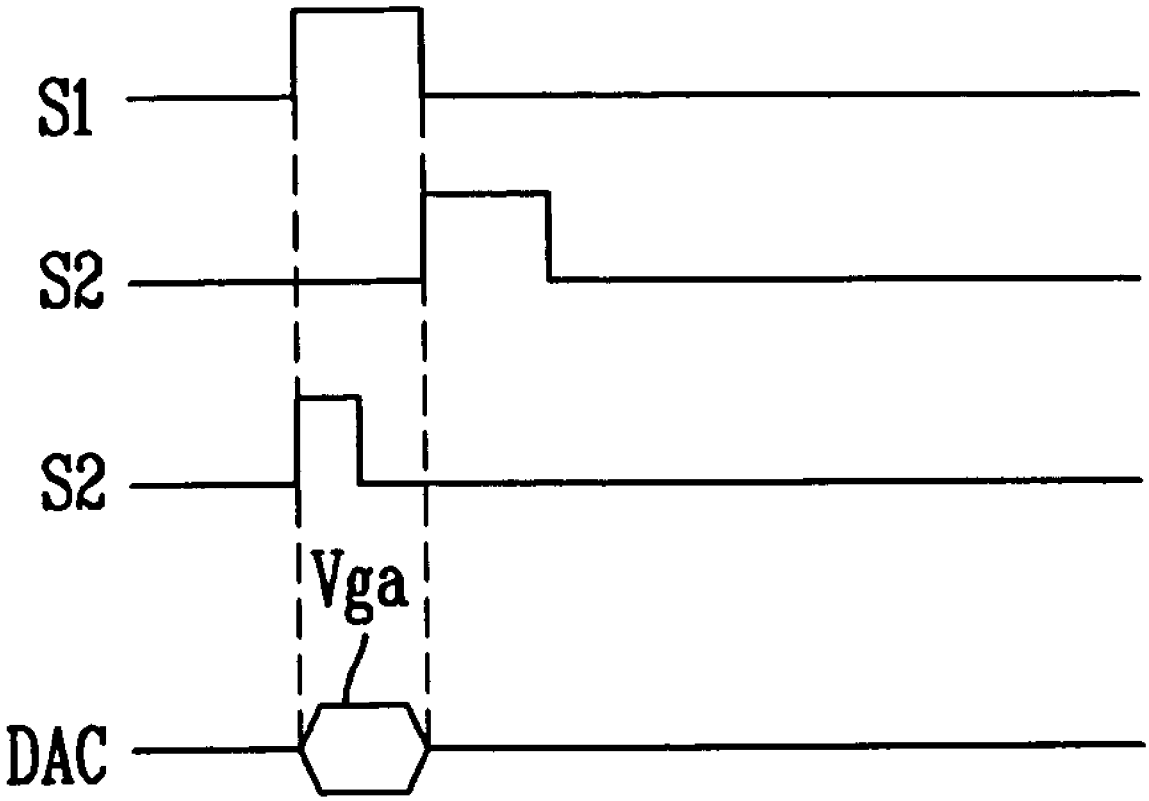
FIG. 8 shows waveforms of signals supplied to the buffer circuit of FIG. 7.

FIG. 7 is a circuit diagram of a second embodiment of the buffer circuit of FIGS. 2 and 3, and FIG. 8 shows waveforms of signals supplied to the buffer circuit of FIG. 7. In description for FIG. 7, repetitive descriptions will be avoided with regard to like configuration to FIG. 4.

Referring to FIGS. 7 and 8, in a buffer 127 according to the second embodiment, a fourth transistor M4 is connected between a gate terminal and a drain terminal of a first transistor M1. Therefore, when the fourth transistor M4 is turned on, the first transistor M1 is connected like a diode. Actually, the buffer according to the second embodiment has the same configuration as that of the first embodiment except for the configuration of the fourth transistor M4.

The buffer 127 operates as follows. First, a first control signal S1 and a third control signal S3 are supplied from an external source at the same time. The third control signal S3 has a narrower pulse width than the first control signal S1. Therefore, the third control signal S3 drops before the first control signal S1 drops down. When the first and third control signals S1 and S3 are supplied, a second transistor M2, a sixth transistor M6, a seventh transistor M7, the fourth transistor M4, and the fifth transistor M5 are turned on.

When the sixth and seventh transistors M6 and M7 are turned on, a voltage corresponding to about one-half of the third power VVDD is applied to a second node N2, a third node N3, a fourth node N4, and a fifth node N5. When the second transistor M2 is turned on, a gradation voltage Vga is supplied by a DAC 125 to the first node N1. Then, the first capacitor C1 is charged with a voltage corresponding to the difference between the gradation voltage Vga and the voltage (about ½ VVDD) applied to the second node N2.

When the fifth transistor M5 is turned on, voltage of a seventh node N7 drops down to fourth power VVSS. Thereafter, the third control signal S3 is interrupted, and thus the fifth transistor M5 is turned off. As the fifth transistor M5 is turned off, voltage obtained by subtracting the threshold voltage of the first transistor M1 from a power source voltage VCC is supplied to a sixth node N6, thereby turning off the first transistor M1.

Thereafter, the first control signal S1 is interrupted, and then the second control signal S2 is supplied, so that the third transistor M3 is turned on, thereby supplying the voltage of the third power VVSS to the first node N1. Then, the voltage applied to the first node N2 drops down from the gradation voltage Vga to the voltage of the third power VVSS, thereby dropping down the voltage of the second node N2. When the voltage of the second node N2 drops down, the voltages of the third node N3 and the fourth node N4 are increased by a first inverter 127*a*. In this case, the increased voltage of the fourth node N4 has a higher absolute value than the voltage drop of the second node N2.

When the voltage of the fourth node N4 increases, the voltages of the fifth node N5 and the sixth node N6 are dropped down by a second inverter 127*b*. At this time, the voltage drop of the sixth node N6 has a higher absolute value than the increased voltage of the fourth node N4. When the voltage of the sixth node N6 drops down, the first transistor M1 formed of a p-type is turned on, thereby applying a predetermined current from the third power VVDD to the seventh node N7. Furthermore, when the gradation voltage Vga is applied to the seventh node N7, the first transistor M1 is turned off. In this respect, the gradation voltage Vga applied to the seventh node N7 is supplied as a data signal to a data line D.

Meanwhile, when the gradation voltage Vga is applied to the seventh node N7, the voltage of the second node N2 connected to the seventh node N7 is increased by the fourth capacitor C4. Then, the voltage of the fourth node N4 drops down, and therefore the voltage of the sixth node N6 increases. As the voltage of the sixth node N6 increases, the p-type first transistor M1 is turned off.

As described above, the present invention provides a buffer circuit and an organic light emitting display with a data integrated circuit using the same, in which a gradation voltage is supplied regardless of threshold voltages of transistors. According to an embodiment of the present invention, the buffer can supply the gradation voltage regardless of the threshold voltages of the transistors, so that it is applicable to drive a wide-screen and high-resolution panel.

Although a few embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A buffer, comprising:

a first capacitor for receiving a gradation voltage through a first terminal;

a first inverter having an input terminal connected to a second terminal of the first capacitor;

a second capacitor having a first terminal connected to an output terminal of the first inverter;

a second inverter having an input terminal connected to a second terminal of the second capacitor;

a third capacitor having a first terminal connected to an output terminal of the second inverter and supplying a voltage;

a first transistor connected to a second terminal of the third capacitor, and controlling current flowing from a first power source to a data line so as to supply the gradation voltage to the data line in correspondence to the voltage supplied by the third capacitor;

a second transistor connected to the first terminal of the first capacitor, and supplying the gradation voltage to the first capacitor in response to a first control signal;

a third transistor connected between the first terminal of the first capacitor and a second power source, and controlled by a second control signal;

a fourth transistor connected between the second terminal of the third capacitor and the first power source, and controlled by the first control signal; and a fifth transistor connected between the data line and the second power source, and controlled by the first control signal.

2. The buffer according to claim 1, wherein the third capacitor supplies the voltage to the first transistor, and an absolute value of the voltage supplied by the third capacitor to the first transistor is higher than the gradation voltage.

3. The buffer according to claim 1, wherein the first power source has a higher voltage than the second power source.

4. The buffer according to claim 1, further comprising a fourth capacitor connected between the input terminal of the first inverter and a common terminal to which the fifth transistor and the data line are commonly connected, and controlling voltage supplied to the first inverter in correspondence to voltage applied to the common terminal.

5. The buffer according to claim 4, wherein the first transistor is turned off when the voltage applied to the common terminal is equal to the gradation voltage.

6. The buffer according to claim 4, further comprising:

a sixth transistor connected between the input terminal and the output terminal of the first inverter, and controlled by the first control signal; and a seventh transistor connected between the input terminal and the output terminal of the second inverter, and controlled by the first control signal.

7. The buffer according to claim 6, wherein the first inverter comprises an eighth transistor and a ninth transistor which are connected between the first power source and the second power source, and which are different in impurity type.

8. The buffer according to claim 7, wherein the second inverter comprises a tenth transistor and an eleventh transistor which are connected between the first power source and the second power source, and which are different in impurity type.

9. The buffer according to claim 1, wherein the first control signal and the second control signal are transmitted in sequence.

10. The buffer according to claim 9, wherein the gradation voltage is supplied to the second transistor in response to the first control signal.

11. A data integrated circuit, comprising:

a shift register part;

a latch part for storing data corresponding to signals supplied in sequence from the shift register part;

a D/A converter for generating gradation voltage corresponding to a gradation level of the data; and a plurality of buffers for supplying the gradation voltage to a data line;

wherein each buffer comprises:

a first capacitor for receiving external gradation voltage through a first terminal;

a first inverter having an input terminal connected to a second terminal of the first capacitor;

a second capacitor having a first terminal connected to an output terminal of the first inverter;

a second inverter having an input terminal connected to a second terminal of the second capacitor;

a third capacitor having a first terminal connected to an output terminal of the second inverter;

a first transistor connected to a second terminal of the third capacitor, and controlling current flowing from a first power source to a data line so as to supply the gradation voltage to the data line in correspondence to the voltage supplied by the third capacitor;

a second transistor connected to the first terminal of the first capacitor, and supplying the gradation voltage to the first capacitor in response to a first control signal;

a third transistor connected between the first terminal of the first capacitor and a second power source, and controlled by a second control signal;

a fourth transistor connected between the second terminal of the third capacitor and the first power source, and controlled by the first control signal; and a fifth transistor connected between the data line and the second power source, and controlled by the first control signal.

12. The data integrated circuit according to claim 11, wherein the third capacitor supplies the voltage to the first transistor, and an absolute value of the voltage supplied by the third capacitor to the first transistor is higher than the gradation voltage.

13. The data integrated circuit according to claim 11, wherein the first power source has a higher voltage than the second power source.

14. The data integrated circuit according to claim 11, further comprising a fourth capacitor connected between the input terminal of the first inverter and a common terminal to which the fifth transistor and the data line are commonly connected, and controlling voltage supplied to the first inverter in correspondence to voltage applied to the common terminal.

15. The data integrated circuit according to claim 14, wherein the first transistor is turned off when the voltage applied to the common terminal is equal to the gradation voltage.

* * * * *